US005800161A

United States Patent [19]

Drigani et al.

[11] Patent Number: 5,800,161

[45] Date of Patent: Sep. 1, 1998

[54] HEATING AND/OR TEMPERATURE-MAINTAINING FURNACE FOR SLABS

[75] Inventors: Fausto Drigani, Zugliano; Pietro Morasca, Fresonara, both of Italy

[73] Assignee: Danieli & C. Officine Meccaniche SpA, Buttrio, Italy

[21] Appl. No.: 325,587

[22] Filed: Oct. 19, 1994

[30] Foreign Application Priority Data

Oct. 19, 1993 [IT] Italy ..... UD93A0209

[51] Int. Cl.[6] ..... F27B 9/00

[52] U.S. Cl. ..... 432/121; 432/123; 432/246

[58] Field of Search ..... 437/121, 123, 437/246

[56] References Cited

FOREIGN PATENT DOCUMENTS 302257 7/1988 European Pat. Off. ..... F27B 9/38

*Primary Examiner*—Henry A. Bennett
*Assistant Examiner*—Siddharth Ohri
*Attorney, Agent, or Firm*—Antonelli, Terry, Stout & Kraus

[57] ABSTRACT

Heating and/or temperature-maintaining furnace (11) for slabs (35), which includes lateral intake (12*a*) and outlet (12*b*) roller conveyors the axis of which is at a right angle to the axis of movement of the slabs (35) within the furnace (11), the roller conveyors (12*a*–12*b*) consisting of a plurality of roller-bearing bogies (13) able to move at a right angle to the axis of the roller conveyors (12*a*–12*b*), the roller-bearing bogies (13) having a first maintenance/replacement position (13*a*) outside the furnace (11) and a second working position (13*b*) in which they cooperate with the inside of the furnace (11), means being also included for the movement of the slabs (35) in the furnace (11), the rollers (10) being supported at both their ends on the roller-bearing bogies (13) by supporting means (19) and being driven by appropriate motor means (21), the supporting means (19) and motor means (21) being located outside the furnace (11) when the roller-bearing bogies (13) is brought to its second working position (13*b*), the ends of the rollers (10) being accessible from outside the furnace (11), an insulated bottom (39) and insulated sidewalls (22) being included in the roller-bearing bogies (13) to protect the roller-supporting means (19) and the motor means (21) associated with the rollers (10).

17 Claims, 2 Drawing Sheets

HEATING AND/OR TEMPERATURE-MAINTAINING FURNACE FOR SLABS

BACKGROUND OF THE INVENTION

This invention concerns a heating and/or temperature-maintaining furnace for slabs.

The heating and/or temperature-maintaining furnace according to the invention comprises an intake roller conveyor and an outlet roller conveyor for the slabs, which are advantageously of a type having a great width and a heavy weight, that is to say, slabs having a width up to 2500–3000 mm. and a thickness from 30 mm. up to 200 mm.

With a view to reducing greatly the dimensions of the doors for access to the furnace as compared to those required for a frontal entry into and exit from the furnace and to achieving a great reduction of the losses of heat during the operations of moving the product, furnaces have been disclosed in which the entry into and exit from the furnace take place laterally with the axis of movement of the slab at a right angle to the axis of movement of the slab inside the furnace.

This embodiment makes possible also a better seal engagement of the plant for gases and a better control of the problems of a mechanical type resulting from the operation of movable closure systems of great dimensions.

Rollers have been employed so far which are installed as cantilevers and of which the working surface is placed sideways to the position of the supports of their rotary shaft so as to keep outside the furnace the mechanical parts which support and rotate the rollers.

This embodiment can be applied only to iron and steel products of a long type such as billets, blooms and narrow slabs but cannot be applied to products having a great width and heavy weight such as the slabs of the type described above.

In view of the dimensions required for the rollers the state of the art entails many and substantial losses of heat along the drive shaft of the rollers.

Moreover, in view of the great weights involved, the embodiment of the state of the art does not enable the required levelness and stability of the roller conveyor to be ensured.

So as to obviate these problems, DE-C-37 36 674 and DE-C-37 38 317 have disclosed embodiments whereby the slabs are moved into the furnace on a roller conveyor consisting of a plurality of pairs of coaxial and opposed rollers, each roller of each pair being installed on its own roller-bearing bogies positioned outside and to one side of the furnace.

According to these documents each roller-bearing bogies includes one or more rollers placed side by side and parallel to each other; these roller-bearing bogies can move at a right angle to the direction of movement of the slabs inside the furnace and thus define an inspection and maintenance position, in which the rollers are outside the furnace, and a working position, in which the rollers are inside the furnace.

By means of this embodiment the weight of the slabs being moved is distributed evenly among the rollers arranged on the bogies positioned respectively on one side and the other side of the furnace.

This embodiment, however, does not enable the problems associated with the heavy weight of the slabs being moved to be overcome wholly inasmuch as the shafts on which the rollers are installed are fitted as cantilevers on the roller-bearing bogies and therefore undergo great bending moments and thus cannot ensure at the same time a correct levelness of the slab being moved.

Moreover, this embodiment cannot be applied to furnaces in which the slabs are moved at a right angle to their lengthwise axis.

Furthermore, these roller-bearing bogies remain supported on their movement wheels even when the rollers are brought to the working position inside the furnace and cooperate with the slabs being moved, with the result that the impacts caused by the moving slabs are fully discharged onto the wheels of the roller-bearing bogies, and this may lead to incorrect working of the roller conveyors.

In fact the halting of the slab being charged into the furnace causes an impact the repercussions of which have an effect on the stability and strength of the structure itself, such impacts over a period of time causing displacements and misalignments which may lead to an incorrect working of the intake and outlet roller conveyors.

EP-A-0 302 257 discloses roller-bearing bogies positioned outside the furnace and sideways thereto; these roller-bearing bogies with the rollers fitted as cantilevers can move at a right angle to the lengthwise axis of the furnace so as to move the slab at a right angle to its own lengthwise axis into the furnace from the feeding roller conveyor to the supporting means present inside the furnace and then from those supporting means to the discharge roller conveyor.

These bogies and these rollers too entail the same problems as those detailed above regarding the prior art documents cited above.

SUMMARY OF THE INVENTION

The present applicants have designed, tested and embodied this invention to overcome the shortcomings of the state of the art and to achieve further advantages.

The slabs in the heating and/or temperature-maintaining furnaces according to the invention are moved at a right angle to their own lengthwise axis from the intake roller conveyor to the outlet roller conveyor, these roller conveyors consisting of rollers having a double support.

The furnace according to the invention includes a suitably cooled refractory hearth arranged between the intake roller conveyor and the outlet roller conveyor; the slabs are deposited momentarily on that hearth for their temperature equalisation.

The rollers with the double support are upheld by the supports at their two ends and are installed in assemblies of one or more rollers on a roller-bearing bogies fitted to wheels that run on rails parallel to the axes of the rollers; this roller-bearing bogies has a first maintenance or replacement position outside the furnace and a second working position in which it cooperates with the inside of the furnace.

Each roller-bearing bogies has a bottom and sidewalls which are suitably insulated, and the rollers protrude above the front sidewall nearest to the furnace and are covered by the rear sidewall, farthest from the furnace, of the roller-bearing bogies.

Each roller-bearing bogies is associated with axial drive means which are suitable to displace the bogies from its first maintenance or replacement position to its second working position and viceversa.

The roller-bearing bogies in the working position has means to support its rollers and motor means to drive its rollers, these means being positioned outside the furnace and suitably protected against the heat by the insulated walls of the bogies itself.

This arrangement of installing the rollers on movable roller-bearing bogies enables the operations of maintenance and/or replacement of the rollers to be made easier and quicker.

Moreover, with the arrangement according to the invention the operations of controlling the condition of the rollers and/or of the means that moves and cools the rollers can also be carried out quickly and simply by moving to the maintenance position the roller-bearing bogies of the rollers to be controlled.

The motor means that drive the rollers and the means that support the rollers are located in open air at the ambient temperature.

According to a variant the means that support the rollers and the motors that drive the rollers may be lodged advantageously in an environment in which cooled air is circulated so as to ensure a high thermal-mechanical reliability of those components.

According to the invention the ends of the individual rollers are always accessible from outside the furnace and cooperate with means for the intake and outlet of cooling fluid, this cooling fluid cooling the rollers and the supporting bearings associated with the rollers.

The roller-bearing bogies includes first alignment and lifting means, which cooperate with lead-in means when the roller-bearing bogies are in the working position.

According to a variant the lead-in means are associated with abutment stop means; these lead-in means advantageously are shaped so as to mate with the alignment means and also, according to a variant, act as means to position and clamp the bogies.

Next the invention provides second lifting means which cooperate with the rear sidewall, farthest from the furnace, of the roller-bearing bogies when the bogies is brought to its working position.

These first lifting means and second lifting means have the task of keeping the wheels of the roller-bearing bogies raised from the rails when the bogies is brought to its working position.

The rear lateral part of the roller-bearing bogies, when it is positioned in the working position, cooperates with lateral alignment means, which ensure correct positioning and reliable clamping of the roller-bearing bogies in the working position.

In this way the strong impacts caused by the halting of the slabs are prevented from affecting the supporting wheels of the bogies and the conveyor.

Clamping means cooperate with the rear side part of the roller-bearing bogies in the working position and can be momentarily actuated; they are solidly fixed to the supporting structure of the rails and are actuated by actuator means.

These clamping means have the purpose of making the alignment and lifting means of the roller-bearing bogies cooperate with the lead-in means and of keeping the bogies clamped in its working position.

According to a special form of embodiment of the invention the rollers fitted to the roller-bearing bogies define a working surface located in a position lower than the refractory hearth of the heating furnace; this special embodiment makes possible a substantially independent thermal operation of the zones of entry into and/or exit from the actual heating zone. It enables a better control to be made of the temperature, whether as a value or as regards uniformity, and also of the zone in which the rollers are located and of the product moved therein.

It is also possible to reduce the flow of energy towards the rollers in such a way as to make possible an appreciable increase of the thermal-mechanical reliability of the supports and of the rollers themselves.

Furthermore, the operations of collecting the slag are facilitated with the rollers with the double supports.

The furnace according to the invention also includes means to move the slab inside the furnace; these movement means comprise traversing means which take the slab from the intake roller conveyor and bring it to the refractory hearth or directly to the outlet roller conveyor.

These traversing means consist of slab-bearing trolleys which can be moved vertically or on the horizontal plane; they can be moved on the horizontal plane in a direction at a right angle to the axis of the furnace and are moved on rails positioned between the roller-bearing bogies.

These slab-bearing trolleys include at their upper end a supporting frame upholding a suitably cooled plate of a refractory material, which is caused to cooperate momentarily with the slab being moved; this frame consists advantageously of a plurality of tubular pipes in which the cooling fluid circulates; these pipes are arranged parallel to the axis of the rollers and at a right angle to the slab so as to take up little lateral space and to permit movement of the roller-bearing bogies.

According to a first form of embodiment the frame cooperates with lifting means associated with the slab-bearing trolley so as to enable the slab to be taken from the intake roller conveyor and to be deposited on the refractory hearth of the furnace or on the outlet roller conveyor.

According to a second form of embodiment the supporting surface associated with the rails on which the slab-bearing trolleys run can be moved vertically to raise and lower the slab-bearing trolley by the required distance.

BRIEF DESCRIPTION OF THE DRAWINGS

The attached figures are given as a non-restrictive example and show two preferred embodiments of the invention as follows.

DETAILED DESCRIPTION OF THE PREFERRED EMBODIMENTS

Figure 1:
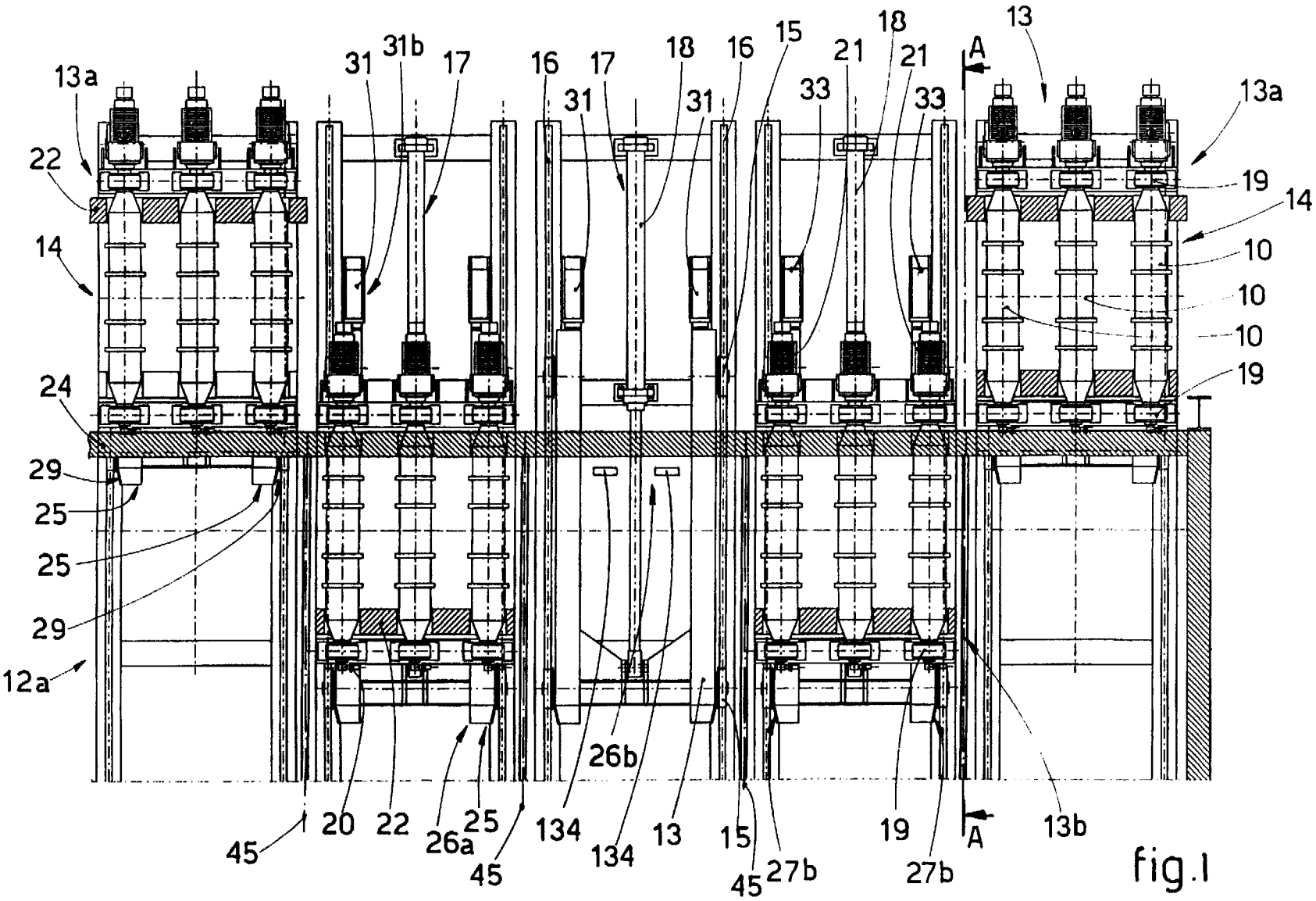
FIG. 1 shows a partial plan view of an intake/outlet roller conveyor for slabs in a heating and/or temperature-maintaining furnace according to the invention.

In the attached figures the reference number 11 denotes generally a heating and/or temperature-maintaining furnace according to the invention.

The heating and/or temperature-maintaining furnace according to the invention contains an intake roller conveyor 12*a* and also an outlet roller conveyor 12*b* analogous to the intake roller conveyor 12*a*.

In the heating and/or temperature-maintaining furnace 11 according to the invention these roller conveyors 12 have their rollers 10 supported at both ends.

The intake roller conveyor 12*a* and the outlet roller conveyor 12*b*, are installed respectively at the beginning and end of the heating and/or temperature-maintaining furnace 11.

The furnace 11 according to the invention comprises also a refractory hearth 36 positioned between the intake roller conveyor 12*a* and the outlet roller conveyor 12*b*; the slabs 35 are deposited momentarily on the hearth 36 to ensure equalisation of their temperature.

To avoid excessive overheating, the refractory hearth 36 is equipped advantageously with cooling means 41, which in this case consist of a plurality of pipes 42 arranged below the refractory hearth 36 for circulation of a cooling fluid.

The roller conveyors 12 are arranged with their lengthwise axis at a right angle to the lengthwise axis of the furnace 11 and to the direction of movement of slabs 35 within the furnace 11.

The slab 35 fed to the furnace 11 moves on the intake roller conveyor 12*a*, whence it is taken by handling means comprising traversing means 40, which can move lengthwise in the furnace 11 and deposit the slab 35 on the refractory hearth 36 of the heating furnace 11 or on the outlet roller conveyor 12*b*.

In this case analogous traversing means 40 are included in the final part of the furnace 11 and cooperate with the slab 35 in taking it from the refractory hearth 36 and depositing it on the rollers 10 of the outlet roller conveyor 12*b* for discharge.

The traversing means 40 in the furnace 11 according to the invention consist of slab-bearing trolleys 43 including at their lower end supporting wheels 44, which run on rails 45 associated with a supporting surface 54.

The slab-bearing trolleys 43 include at their upper end a supporting frame 46, which consists of hollow tubular pipes 48 and to which a refractory plate 47 is secured.

The tubular pipes 48 are arranged parallel to the axis of the rollers 10 so as to enable the rollers and pipes to be moved reciprocally in an independent manner.

The tubular pipes 48 are associated at their lower end, by means of attachments 49, with hoses 50 that circulate a cooling liquid.

Figures 2A, 2B:
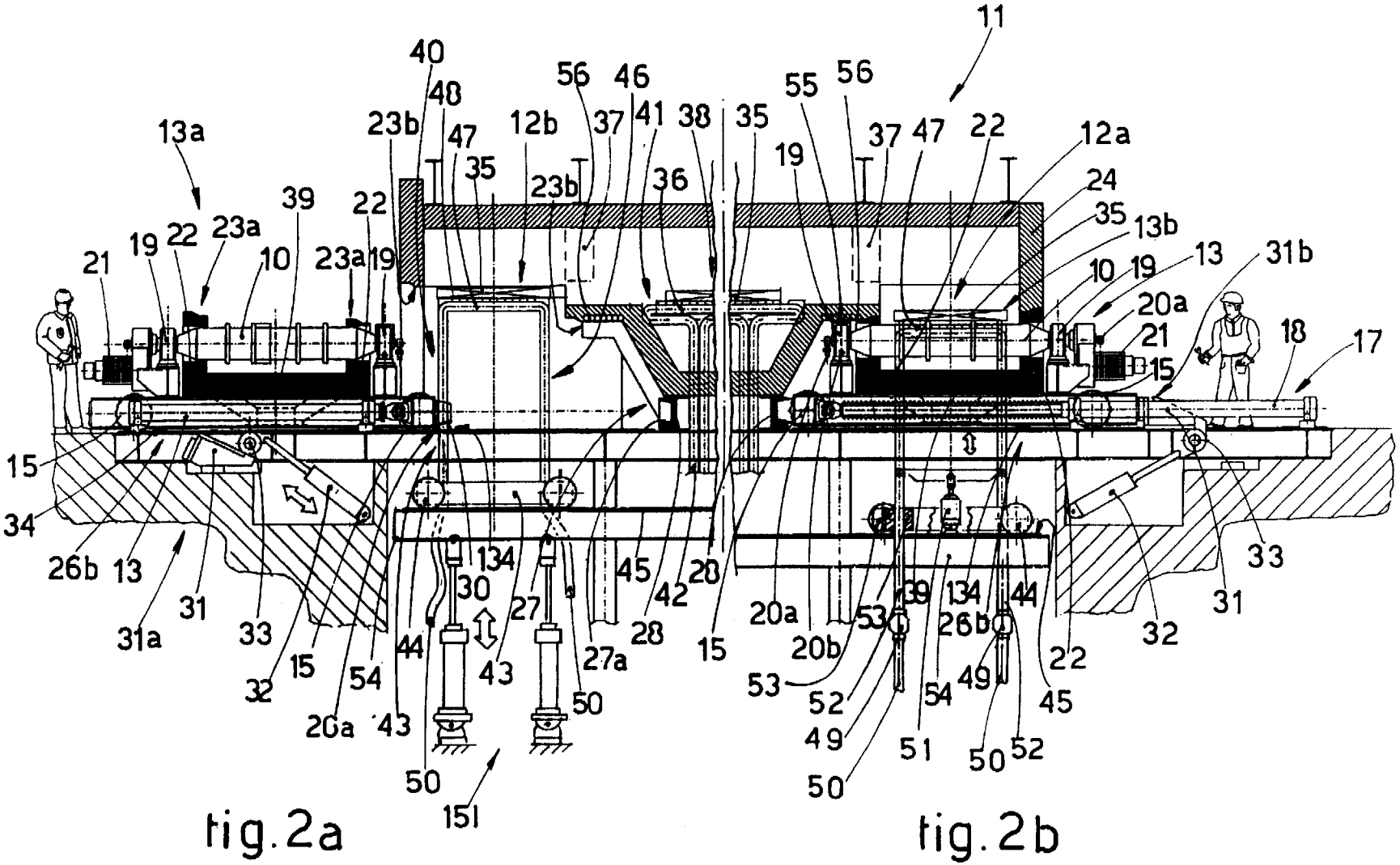
FIGS. 2*a* and 2*b* show in a reduced scale a section along the line A—A of two variants of the heating and/or temperature-maintaining furnace of FIG. 1.

According to a first form of embodiment shown in FIG. 2*b* the slab-bearing trolley 43 includes lifting means 51, actuators in this case, which are associated with uprights 52 of the supporting frame 56; these uprights 52 are fitted so as to be able to slide vertically within guides 53 associated with the slab-bearing trolley 43.

According to a second form of embodiment shown in FIG. 2*a* the supporting surface 54 associated with the rails 45 can be moved vertically and is associated at its lower end with lifting means 151 of an actuator type.

By acting on the lifting means 51 or 151 the refractory plate 47 is raised until it cooperates with the slab 35 and lifts the slab 35 from the rollers 10 associated with the roller-bearing bogies 13 of the intake roller conveyor 12*a* or from the refractory hearth 36 of the furnace 11.

The slab-bearing trolleys 43 are then traversed until they have brought the slab 35 to the refractory hearth 36 of the furnace 11 or to the rollers 10 associated with the roller-bearing bogies 13 of the outlet roller conveyor 12*b*, where the lifting means 51–151 are lowered.

Each of the intake roller conveyor 12*a* and outlet roller conveyor 12*b* comprises a plurality of roller-bearing bogies 13 positioned side by side, on each of which is installed an assembly 14 consisting of a plurality of rollers 10; in this case each assembly 14 consists of three rollers 10 positioned side by side.

According to some variants the rollers 10 installed on a single bogies 13 are two or four in number or are of yet another number.

The roller-bearing bogies 13 are installed on wheels 15 at their front and rear, the wheels 15 cooperating with guide rails 16, and have a first maintenance or replacement position 13*a* outside the furnace 11 and a second working position 13*b*, in which the bogies 13 is inside the furnace 11.

The guide rails 16 are advantageously positioned between rails 45 associated with the slab-bearing trolleys 43 in such a way as to enable the slab-bearing trolleys 43 and the roller-bearing bogies 13 to be moved independently of each other.

Each roller-bearing bogies 13 is associated with axial drive means 17 consisting of a first actuator 18 in this case.

The roller-bearing bogies 13 can be moved in a direction parallel to the axis of movement of the slab 35 in the furnace 11 and therefore at a right angle to the direction of feed of the slab 35 into, and of exit of the slab 35 from, the furnace 11.

Each roller 10 according to the invention cooperates at its ends with supporting means 19 which in this case consist of bearings fitted to the roller-bearing bogies 13.

The double support of the rollers 10 makes it possible to keep modest the dimensions of the supporting means 19 and of the rollers 10 themselves with a resulting reduction of the dispersion of heat as between the furnace 11 and the cooled rollers 10.

Both the supporting bearing means 19 and the rollers 10 themselves according to the invention comprise respective connecting means 20*a* and 20*b* for the entry and exit of a cooling fluid fed by a suitable cooling circuit, which is not shown here.

The roller-bearing bogies 13 in its working position 13*b* comprises the supporting bearing means 19 and motors 21 to drive the rollers 10, the bearings 19 and motors 21 being outside the furnace 11 and suitably insulated therefrom.

In this case the roller-bearing bogies 13 includes a bottom 39 and sidewalls 22 made of an insulating refractory material. The sidewalls 22 of the bogies 13 in this case include seal engagement elements 23*a*, which cooperate in the working position 13*b* of the bogies 13 with seal engagement elements 23*b* having a mating form and comprised in sidewalls 24 of the furnace 11 and in containing walls 55 of the refractory hearth 36 to prevent losses of heat outwards and towards the supporting bearings means 19 of the rollers 10.

So as to prevent contacts with the sidewalls 24 of the furnace 11 according to the invention, the seal engagement elements 23*a* comprised on the front sidewall 22, nearer to the furnace 11, of the roller-bearing bogies 13 and cooperating with the mating seal engagement elements 23*b* comprised on the containing wall 55 of the refractory hearth 36 are lower than the seal engagement elements 23*a* comprised on the rear sidewall 22 of the roller-bearing bogies 13 and cooperating with the mating seal engagement elements 23*b* comprised on the sidewall 24 of the furnace 11.

In this case the containing walls 55 of the refractory hearth 36 advantageously contain within them pipes 56 for the circulation of a cooling fluid.

The roller-bearing bogies 13 includes at its frontal end alignment means 25 and frontal lifting means 26*a* which cooperate with lower 27*a* and lateral 27*b* lead-ins 27 associated with abutment stop means 28 of the bogies 13.

The alignment means 25 in this case consist of forwardly converging lateral faces 29 of the frontal part of the bogies 13; these forwardly converging lateral faces 29 cooperate with mating lateral faces 27*b* of the lead-ins 27 on the abutment stop means 28.

The frontal lifting means 26*a* consists in this case of a lower inclined surface 30 which the roller-bearing bogies 13 include in their frontal part and which cooperates with the lower mating surface 27a of the lead-ins 27 on the abutment stop means 28.

The roller-bearing bogies 13 according to the invention comprises, on its lower side in an intermediate position displaced towards its rear wheels 15, rear lifting means 26b consisting in this case of wedges 34, which cooperate with mating wedges 134 arranged in a coordinated position on the surface of movement and lift the rear wheels 15 of the roller-bearing bogies 13 from the rails 16 when the bogies 13 is in its working position 13b.

In the working position 13b the roller-bearing bogies 13 therefore has its rear wheels 15 raised from the rails 16 and thus resists suitably the stresses generated by impacts caused by the halting of the slabs 35 being fed.

Rear alignment means cooperate advantageously with the rear part of the roller-bearing bogies 13 in the working position 13b and prevent lateral displacements of the bogies 13 even if the latter undergoes strong stresses.

These rear alignment means, which are not shown here, may comprise inclined surfaces solidly fixed to the immovable structure of the furnace 11; these surfaces cooperate with the lateral sides of the roller-bearing bogies 13 and clamp the bogies in its working position.

Clamping means 31 are caused to cooperate with the rear part of the roller-bearing bogies 13 so as to keep the bogies 13 clamped in position in the raised working position 13b; these clamping means 31 have a first retracted inactive position 31a and a second clamping position 31b in which they cooperate with the rear part of the roller-bearing bogies 13.

In this example the clamping means 31 are pivoted at 33 and are moved by a second actuator 32.

In this case the intake roller conveyor 12a and outlet roller conveyor 12b respectively form a working surface lying at a lower position than that of the refractory hearth of the furnace 11 (see FIGS. 2a and 2b).

This particular feature together with the fact that each roller conveyor 12 can be separated from the central zone 38 of the furnace 11 by a relative refractory partition 37, shown with lines of dashes in FIGS. 2a, and 2b makes possible a substantially independent thermal management and a more uniform control of the temperature within the furnace 11.

We claim:

1. Heating and/or temperature-maintaining furnace for slabs, comprising lateral intake and outlet roller conveyors the axis of which is at a right angle to the axis of movement of the slabs within the furnace, the roller conveyors comprising a plurality of roller-bearing bogies able to move at a right angle to the axis of the roller conveyors, the roller-bearing bogies having a first maintenance/replacement position outside the furnace and a second working position in which they cooperate with the inside of the furnace, means for the movement of the slabs in the furnace, wherein the rollers are supported at both their ends on the roller-bearing bogies by supporting means and are driven by appropriate motor means, the supporting means and motor means being located outside the furnace when the roller-bearing bogies is brought to its second working position, the ends of the rollers being accessible from outside the furnace, an insulated bottom and insulated sidewalls being included in the roller-bearing bogies to protect the roller-supporting means and the motor means associated with the rollers.

2. Furnace as in claim 1, in which in the second working position the rollers form a working surface lower than a refractory hearth of the furnace and separated from a central zone of the furnace by refractory partitions.

3. Furnace as in claim 1, wherein the roller-bearing bogies has wheels movable along rails, and wherein, in the second working position, the wheels of the roller-bearing bogies are removed from their respective rails.

4. Furnace as in claim 1, in which the sidewalls of the roller-bearing bogies include seal engagement elements having a form mating with seal engagement elements included in a coordinated position on the respective sidewalls of the furnace and on containing walls of the refractory hearth with which those sidewalls cooperate in the second working position of the roller-bearing bogies.

5. Furnace as in claim 4, in which the seal engagement elements included on the frontal sidewall, nearer to the furnace, of the roller-bearing bogies and the mating seal engagement elements included on the containing wall of the refractory hearth are lower than the seal engagement elements included on the rear sidewall of the roller-bearing bogies and the mating seal engagement elements included on the sidewall of the furnace.

6. Furnace as in claim 4, in which the containing wall of the refractory hearth of the furnace contains cooling pipes in which a cooling fluid circulates.

7. Furnace as in claim 1, in which clamping means which can be momentarily operated cooperate with the rear lateral part of the roller-bearing bogies in the working position.

8. Furnace as in claim 1, in which the roller-bearing bogies comprises in its frontal lateral portion alignment means and frontal lifting means, which cooperate in the working position with lateral and lower lead-ins associated with abutment stop means.

9. Furnace as in claim 1, in which the roller-bearing bogies includes rear lifting means, which cooperate in the second working position with mating wedge means located in a coordinated position on the surface on which the roller-bearing bogies is moved.

10. Furnace as in claim 1, in which the roller-bearing bogies includes in its rear portion lateral alignment mean which in the working position cooperate with mating means solidly fixed to the stationary structure of the furnace.

11. Furnace as in claim 1, in which the means supporting the rollers and the motors means driving the rollers are located in an environment in which cooled air is circulated.

12. Furnace as in claim 1, in which the means supporting the rollers and the motors means driving the rollers are located in the open air at the ambient temperature.

13. Furnace as in claim 1, in which the rollers and their supporting bearings include connecting means for the entry and exit of a cooling fluid.

14. Furnace as in claim 1, in which the means positioned within the furnace to move the slabs traversing means to traverse the slab so as to take the slab from the intake roller conveyor and to position the slab on the refractory hearth or on the outlet roller conveyor, these traversing means being able to move in a direction at a right angle to the axis of the slabs.

15. Furnace as in claim 14, in which the traversing means comprise a plurality of slab-bearing trolleys able to move on rails associated with a supporting surface, the trolleys comprising at their upper end suitably cooled refractory plate means.

16. Furnace as in claim 15, in which the slab-bearing trolleys include means to lift/lower the refractory plate means.

17. Furnace as in claim 15, in which the supporting surface cooperates with lifting/lowering means.

* * * * *